US010473358B2

(12) United States Patent
Breed

(10) Patent No.: US 10,473,358 B2
(45) Date of Patent: Nov. 12, 2019

(54) AIR DUCT SEALING SYSTEM FOR OBSTRUCTING OR DIRECTING AIRFLOW THROUGH PORTIONS OF AN AIR DUCT SYSTEM

(71) Applicant: Richard Corey Breed, Austin, TX (US)

(72) Inventor: Richard Corey Breed, Austin, TX (US)

(73) Assignee: Richard Corey Breed, Austin, TX (US)

( * ) Notice: Subject to any disclaimer, the term of this patent is extended or adjusted under 35 U.S.C. 154(b) by 234 days.

(21) Appl. No.: 15/259,932

(22) Filed: Sep. 8, 2016

(65) Prior Publication Data

US 2016/0377311 A1 Dec. 29, 2016

Related U.S. Application Data

(63) Continuation-in-part of application No. 14/187,267, filed on Feb. 22, 2014, now Pat. No. 9,557,073, which is a continuation-in-part of application No. 13/108,957, filed on May 16, 2011, now abandoned, which is a continuation-in-part of application No. 12/757,397, filed on Apr. 9, 2010, now abandoned, which is a continuation-in-part of application No.

(Continued)

(51) Int. Cl.

| | |
|---|---|
| ***F24F 13/20*** | (2006.01) |
| ***F24F 13/072*** | (2006.01) |
| ***F24F 13/08*** | (2006.01) |
| ***F24F 11/72*** | (2018.01) |

(52) U.S. Cl.

CPC ..... *F24F 13/20* (2013.01); *F24F 11/72* (2018.01); *F24F 13/072* (2013.01); *F24F 13/082* (2013.01); *Y10T 29/53909* (2015.01)

(58) Field of Classification Search

CPC ..... F24F 13/08; F24F 13/082; F24F 13/084; F24F 13/20

See application file for complete search history.

(56) References Cited

U.S. PATENT DOCUMENTS 639,476 A 12/1899 Whisler
2,834,278 A * 5/1958 Edmonson, Jr. ..... E04B 1/7076 454/276

(Continued)

OTHER PUBLICATIONS

Office Action dated Oct. 2, 2012 in U.S. Appl. No. 12/757,397.

(Continued)

*Primary Examiner* — Tyrone V Hall, Jr.

(57) ABSTRACT

The present invention discloses removable air duct sealing systems for obstructing and directing airflow through portions of an air duct system. Such air duct sealing systems may include a support plate having opening extending through the support plate from a first side to a second side. Such systems may also include a flange with an interior surface along the opening extending away from one side. Such systems may also include a sawtooth connector operatively coupled to the interior surface of the flange. An exemplary sawtooth connector may include detents configured to catch a backside of a louver of the air vent grill to hold the removable air duct sealing system in place covering the air vent grill.

20 Claims, 7 Drawing Sheets

Related U.S. Application Data

13/754,865, filed on Jan. 30, 2013, now Pat. No. 9,360,230.

(60) Provisional application No. 61/447,104, filed on Feb. 26, 2011.

(56) References Cited

U.S. PATENT DOCUMENTS 3,130,659 A 4/1964 Compton et al.
4,182,227 A 1/1980 Roy
4,502,368 A 3/1985 Hempel
4,520,715 A 6/1985 Coomes et al.
4,617,702 A * 10/1986 Diederich, Jr. .... B65D 63/1072 24/16 PB
4,964,438 A 10/1990 Welty
5,058,519 A * 10/1991 Collins ..... B63B 43/16 114/227
5,147,243 A 9/1992 Inglis
5,192,244 A 3/1993 Rose
5,213,543 A 5/1993 Clarino
5,292,282 A 3/1994 Callas
5,377,510 A 1/1995 Smith
5,421,355 A 6/1995 Cantwell
5,425,674 A 6/1995 Stach
5,479,984 A 1/1996 Easterbrook et al.
5,706,798 A 1/1998 Steinorth
D392,860 S 3/1998 Brown
6,105,908 A 8/2000 Kraus
6,145,527 A 11/2000 Gillis
6,152,157 A 11/2000 Jang
6,287,050 B1 * 9/2001 Montgomery ..... E02B 7/40 405/92
6,317,952 B1 * 11/2001 Vogt ..... E04G 23/0203 29/402.09
6,347,435 B1 2/2002 Davignon
6,499,497 B1 12/2002 Swetish
6,598,614 B2 7/2003 Liu
6,640,395 B2 11/2003 Bush
6,698,440 B2 3/2004 Beyer
6,749,499 B1 * 6/2004 Snyder ..... F24F 13/085 454/284
6,767,279 B1 7/2004 Serrano
6,832,951 B2 12/2004 Orendorff
7,022,011 B1 4/2006 Rickman
7,062,830 B2 6/2006 Alles
7,104,877 B1 9/2006 Terry
7,249,996 B1 7/2007 Volyar
7,575,010 B2 8/2009 Rottmann
7,766,024 B2 8/2010 Rottmann
8,292,708 B2 10/2012 Viggers
8,499,497 B1 8/2013 Hugueley
8,528,271 B1 * 9/2013 Hemmer ..... E04D 13/004 52/101
8,602,044 B2 12/2013 Zemitis
8,628,379 B1 1/2014 Galindo
2002/0069599 A1 * 6/2002 Dhallan ..... F24F 13/082 52/302.1
2004/0023005 A1 2/2004 Perez
2005/0086889 A1 * 4/2005 Shock ..... E04G 23/0207 52/514
2005/0186900 A1 8/2005 Janesky
2008/0196755 A1 8/2008 Cheng
2009/0302544 A1 12/2009 Pugh, Jr.
2010/0207407 A1 8/2010 Walker, Jr.
2010/0233953 A1 9/2010 Mavroudis et al.
2011/0146162 A1 6/2011 Kilhams
2013/0331023 A1 12/2013 Yalmeh
2014/0338705 A1 * 11/2014 Vasquez ..... F16L 33/223 134/22.12

OTHER PUBLICATIONS

Office Action dated Sep. 24, 2013 in U.S. Appl. No. 13/108,957.
Office Action dated Oct. 6, 2015 in U.S. Appl. No. 13/754,865.
Office Action dated May 18, 2016 in U.S. Appl. No. 14/187,267.

* cited by examiner

AIR DUCT SEALING SYSTEM FOR OBSTRUCTING OR DIRECTING AIRFLOW THROUGH PORTIONS OF AN AIR DUCT SYSTEM

This application claims the benefit of and is a continuation-in-part of Non-Provisional application Ser. No. 14/187,267 entitled "Air Duct Sealing System For Obstructing or Directing Airflow Through Portions Of An Air Duct System" and filed on Feb. 22, 2014, which is incorporated herein by reference in its entirety.

Non-Provisional application Ser. No. 14/187,267 claims the benefit of and is a continuation-in-part of Non-Provisional application Ser. No. 13/108,957 entitled "Air Duct Blocking Device For Obstructing Airflow Through Portions Of An Air Duct System" and filed on May 16, 2011, which is incorporated herein by reference in its entirety. Non-Provisional application Ser. No. 13/108,957 claims the benefit of and is a continuation-in-part of Non-Provisional application Ser. No. 12/757,397 entitled "Air Vent Cover For Use In Testing Air Leakage Of An Air Duct System" and filed on Apr. 9, 2010, which is incorporated herein by reference in its entirety. Non-Provisional application Ser. No. 13/108,957 also claims the benefit of Provisional Application No. 61/447,014 entitled "Installation And Removal Tool For Use With An Air Vent Cover For Sealing An Air Vent" and filed on Feb. 26, 2011, which is incorporated herein by reference in its entirety.

Non-Provisional application Ser. No. 14/187,267 also claims the benefit of and is a continuation-in-part of Non-Provisional application Ser. No. 13/754,865 entitled "Air Duct Sealing System For Obstructing or Directing Airflow Through Portions Of An Air Duct System" and filed on Jan. 30, 2013, now issued as U.S. Pat. No. 9,360,230, which is incorporated herein by reference in its entirety. Non-Provisional application Ser. No. 13/754,865 claims the benefit of and is a continuation-in-part of Non-Provisional application Ser. No. 12/757,397 entitled "Air Vent Cover For Use In Testing Air Leakage Of An Air Duct System" and filed on Apr. 9, 2010, which is incorporated herein by reference in its entirety. Non-Provisional application Ser. No. 13/754,865 also claims the benefit of and is a continuation-in-part of Non-Provisional application Ser. No. 13/108,957 entitled "Air Duct Blocking Device For Obstructing Airflow Through Portions Of An Air Duct System" and filed on May 16, 2011, which is incorporated herein by reference in its entirety.

TECHNICAL FIELD

The present invention relates to the field of removable air duct sealing systems for obstructing or directing airflow through portions of an air duct system.

BACKGROUND ART

As the trend to conserve energy continues, more individuals are demanding and more governmental entities are mandating that houses and commercial facilities undergo periodic energy audits. An energy audit is a service where a building structure's energy efficiency is evaluated by a person using professional equipment as blower door and infra-red cameras), with the aim to suggest the best ways to improve energy efficiency in heating and cooling the structure.

An energy audit involves recording various characteristics of the building envelope including the walls, ceilings, floors, doors, windows, and skylights. For each of these components the area and resistance to heat flow (R-value) is measured or estimated. The leakage rate or infiltration of air through the building envelope is of concern and is strongly affected by window construction and quality of door seals such as weather stripping. The goal of an audit is to quantify the building's overall thermal performance. The audit may also assess the efficiency, physical condition, and programming of mechanical systems such as the heating, ventilation, air conditioning (HVAC) equipment, and thermostat.

Leaks in an air duct system often account for a large percentage of energy being wasted in a typical home. In a residence, the percentage of air that escapes out of an air duct system due to leaks, on average, is approximately twenty-five percent (25%). Given that in some areas of the country, sixty percent (60%) to seventy percent (70%) of the cost of a household's monthly utilities bill is due to the operation of the HVAC system, air leakage in an air duct system may represent a significant waste of both monetary and energy resources.

Measuring the leakage in an air duct system is generally the most time consuming portion of a home energy audit. In fact, as much as fifty percent (50%) of the time required to perform a home energy audit is consumed in testing air leakage of an air duct system. The majority of that time is spent sealing off the various air vents so that the air duct system can be pressurized or depressurized to measure the air leaks.

Current methods of sealing off the air vents involve the use of a special adhesive tape that adheres to the face of an air vent. There are, however, certain drawbacks to the use of this adhesive tape. Applying and removing the adhesive tape to all of the air vents takes a significant amount of time because the adhesive tape is cumbersome and awkward to use. Commonly, the tape sticks to itself and those pieces have to be thrown away unused. The tape is generally stored in bulky spools that are heavy and difficult to maneuver. When the tape is removed from the spools, it can generate an extremely loud noise that may wake up members of a home that are asleep during the day, such as, for example a baby or elderly person taking a nap, or be disruptive to ongoing business concerns.

Another drawback is that the tape does not provide the best seal possible for the air duct system. Even after the tape is applied to the air vent, air may still enter and leave the air duct system beneath the face of the air vent that touches the wall or ceilings surface because the tape only blocks the openings of the air vent on the face of the air vent. The tape does not block openings between the air vent and surface on which the air vent is installed. An additional drawback occurs when the tape is removed. Because the tape uses a strong adhesive, damage often occurs to the wall, ceiling, or air vent when the tape is removed.

Even more problematic is the current process of sealing the pressurizing fan system to the return air vent after all of the other air vents have been sealed. In many buildings, the return air vent is located on the ceiling. Sealing the pressurizing fan system to the HVAC system involves awkwardly climbing a ladder with a flexible duct and trying to tape the flexible duct overhead to the air return vent while balancing on the ladder. Often, the weight of the flexible duct pulls the tape away from the air return vent and the operator has to repeat this process several times before adequately sealing the flexible duct to the return vent.

SUMMARY OF INVENTION

The present invention discloses removable air duct sealing systems for obstructing and directing airflow through portions of an air duct system. In some embodiments of the present invention, the removable air duct sealing system may include a support plate having a first side and a second side. Such an exemplary support plate may have an opening extending through the support plate from the first side to the second side. The removable air duct sealing system may include a flange having an interior surface along the opening extending away from the first side. The removable air duct sealing system may include a sawtooth connector operatively coupled to the interior surface of the flange. Such an exemplary sawtooth connector may include a plurality of detents configured to catch the air vent grill to hold the removable air duct sealing system in place covering the air vent grill. In some embodiments of the present invention, the detents may be slanted, each shaped as a parallelogram, each shaped as a triangle, each shaped as a rectangle, or each shaped as a wave. In some embodiments, the sawtooth connector may be flexible while in other embodiments it may be rigid.

In some embodiments of the present invention, the removable air duct sealing system may include a pin mounted to the interior surface of the flange. An exemplary sawtooth connector may be hingably coupled to such a pin. Alternatively, in other embodiments of the present invention, the sawtooth connector may include an interior track and various interior slots adjacent to the interior track configured to allow the sawtooth connector to slide along the pin within the interior track and allow the pin to secure the sawtooth connector relative to the removable air duct sealing system when the pin is positioned in one of the plurality of interior slots and one of the plurality of detents of the sawtooth connector catches the air vent grill. In some embodiments of the present invention, the interior slots may be slanted.

In some embodiments of the present invention, the removable air duct sealing system may include a sawtooth connector that has an angular configuration at the detents to facilitate insertion of the sawtooth connector between louvers of the air vent grill. In some embodiments of the present invention, the removable air duct sealing system may include a gasket configured on the second side of the support plate. Such an exemplary gasket may block airflow through a portion of the air duct sealing system when the gasket is pressed toward the air vent grill. Such an exemplary gasket may be configured along just the perimeter of the support plate or be configured in a substantially planar shape and along substantially all of the second side of the support plate.

In other embodiments of the present invention, a removable air duct sealing system may include a support plate having an opening extending through the support plate from a first side to a second side. Such an exemplary removable air duct sealing system may include a flexible tie with various loops built into the flexible tie. The exemplary flexible tie of such an embodiment of the present invention may be configured to pass through the opening of the support plate. Such an exemplary removable air duct sealing system may also include a crossbar operatively coupled to the distal end of the flexible tie and configured to permit the crossbar and flexible tie to pass through the register boot when positioned in a first orientation and resist removal of the flexible tie from the register boot when positioned in a second orientation. Such an exemplary removable air duct sealing system may further include a sawtooth connector having various detents configured to catch on the first side of the support plate one of the plurality of loops of the flexible tie passing through the support plate and to secure the support plate in a fixed position relative to the register boot when the crossbar is positioned in a second orientation.

In other embodiments of the present invention, an exemplary removable air duct sealing system may include a gasket configured on the second side of the support plate. Such an exemplary gasket may be capable of blocking airflow through the register boot when the gasket is held adjacent to the register boot by tension on the flexible tie as the crossbar is configured in the second orientation and the plurality of detents of the sawtooth connector catches one of the plurality of loops of the flexible tie passing through the support plate.

In still further embodiments of the present invention, a removable air duct sealing system for obstructing airflow through portions of an air duct system may include a suction cup operatively coupled to the distal end of the flexible tie and configured to resist removal of the flexible tie from the register boot when positioned in the register boot. An exemplary sawtooth connector may include various detents configured to catch one of the loops of the flexible tie passing through the support plate thereby securing the support plate in a fixed position relative to the register boot when the suction cup is positioned in the register boot.

BRIEF DESCRIPTION OF DRAWINGS

The accompanying drawings, which are incorporated in and constitute a part of this specification, illustrate an implementation of apparatus and methods consistent with the present invention and, together with the detailed description, serve to explain advantages and principles consistent with the invention. In the drawings, FIG. 1A sets forth a drawing illustrating a perspective view of an exemplary removable air duct sealing system for obstructing or directing airflow through portions of an air duct system according to embodiments of the present invention.

DESCRIPTION OF EMBODIMENTS

This application incorporates by reference in the entirety the specification, including the written description and drawings, of the following applications: Non-Provisional application Ser. No. 14/187,267 entitled "Air Duct Sealing System For Obstructing or Directing Airflow Through Portions Of An Air Duct System" and filed on Feb. 22, 2014; Non-Provisional application Ser. No. 12/757,397 entitled "Air Vent Cover For Use In Testing Air Leakage Of An Air Duct System" and filed on Apr. 9, 2010; Provisional Application No. 61/447,014 entitled "Installation And Removal Tool For Use With An Air Vent Cover For Sealing An Air Vent" and filed on Feb. 26, 2011; Non-Provisional application Ser. No. 13/108,957 entitled "Air Duct Blocking Device For Obstructing Airflow Through Portions Of An Air Duct System" and filed on May 16, 2011; and Non-Provisional application Ser. No. 13/754,865 entitled "Air Duct Sealing System For Obstructing or Directing Airflow Through Portions Of An Air Duct System" and filed on Jan. 30, 2013, now issued as U.S. Pat. No. 9,360,230, all of which are incorporated herein by reference in its entirety.

Figures 1A, 1B:
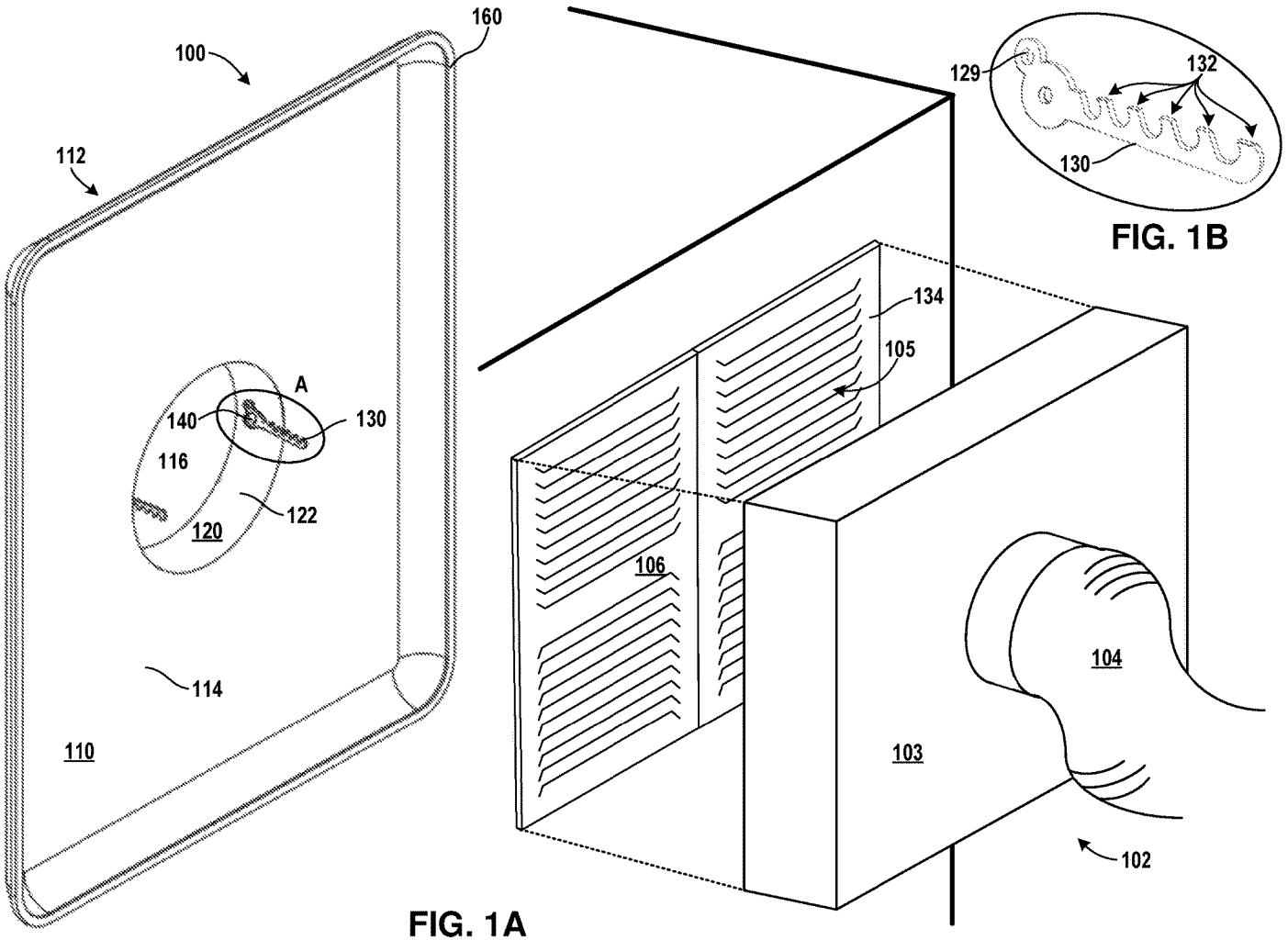
FIG. 1B sets forth a line drawing illustrating a perspective view of the exemplary sawtooth connector of FIG. 1A that is useful in an exemplary removable air duct sealing system for obstructing or directing airflow through portions of an air duct system according to embodiments of the present invention.

Exemplary embodiments of adjustable air duct sealing systems for obstructing airflow through portions of an air duct system are described herein with reference to the accompanying drawings, beginning with FIG. 1A. FIG. 1A sets forth a drawing illustrating a perspective view of an exemplary removable air duct sealing system (100) for obstructing or directing airflow through portions of an air duct system (102) according to embodiments of the present invention. Air duct systems are used in heating, ventilation, and air conditioning (HVAC) to deliver, circulate, or remove air using supply, return, or exhaust airflows. Air duct systems, therefore, are one method of ensuring acceptable indoor air quality as well as thermal comfort.

Though air duct systems vary from one installation to another, many air duct system share a common set of components. Air duct systems generally include an air handler unit that may be composed of a blower or fan, heating or cooling elements, filters, humidifier, mixing chamber, heat recovery device, controls, and vibration isolators. In addition, air duct systems typically include other components such as networks of plenums, ducts, and boots that direct airflow between the air handler unit and various air vents registers used to supply air to or return air from the spaces served by the air duct system. Readers will note that much of the air vent system is omitted from the Figures for clarity as these components are well known and understood by those of skill in the art.

To detect leaks in an air duct system, a technician will typically pressurize or depressurize the air duct system and measure the changes in air pressure throughout the system over time. Exemplary removable air duct sealing systems according to embodiments of the present invention are useful in obstructing airflow through portions of an air duct system. Exemplary removable air duct sealing systems according to embodiments of the present invention typically connect to an air duct system component such as, for example, an air vent register or grill or an air vent register boot. An air vent register is an opening, typically forming a grill, in an air duct system that serves to supply air to or return air from a space served by the air duct system. A register boot is a device that provides a physical interface between an air duct and an air vent register. Those of skill in the art often may collectively refer to an "air vent register" and "register boot" as an air diffuser, an air grate, or a terminal unit.

Exemplary removable air duct sealing systems according to embodiments of the present invention may be placed over the air vent register or register boot to create a seal for inhibiting air flow through the register or boot, and consequently a portion of the HVAC system, while testing air leakage of the air duct system. The air may attempt to flow through the air vent register or register boot due to either pressurization or depressurization of the air duct system during the leak testing process. Systems used to pressurize or depressurize an air duct system are known to those of skill in the art and may include, for example, the Minneapolis Duct Blaster® or the Retrotec Duct Testing Blower System.

Exemplary removable air duct sealing systems according to embodiments of the present invention may also be placed over the larger return vents as well to create a seal for directing air flow through a duct connected to such exemplary air duct sealing systems that is in turn connected to a pressurization or depressurization system such as, for example, those already mentioned. In this manner, exemplary removable air duct sealing systems according to embodiments of the present invention are able to help isolate the air in an HVAC system from the air outside of the HVAC system so that pressurization and/or depressurization may occur for testing purposes.

The exemplary removable air duct sealing system (100) of FIG. 1A obstructs airflow through portions of the air vent grill (106) and directs airflow through the opening (116) of the exemplary removable air duct sealing system (100), which may be connected to a pressurization or depressurization system. In FIG. 1A, the air vent grill (106) is a terminal point of the air duct system (102). The air vent grill (106) is the system boundary between the air mass inside the HVAC system and the air mass outside of the HVAC system. In FIG. 1A, the air duct system (102) has an air duct (104) that is terminated at the air vent grill (106). Register boots (103) serves as physical interface between air vent grill (106) and air duct (104).

The air vent grill (106) of FIG. 1A is mounted adjacent to the surface of the wall. In the example of FIG. 1A, the surface is the interior wall of a room served by the air duct system. In embodiments of the present invention, however, the surface surrounding an air vent may be any surface of a room or structure, including a wall, floor, ceiling, or any other surface as will occur to those of skill in the art. The air vent grill (106) provides a "face" for the air duct system for observers in the room and may serve a decorative or functional purpose. For example, the grill (106) may include an ornamental design, provide a mechanism for directing airflow, or be used to secure the register boot (103) to the surrounding surface of the wall.

The air vent grill (106) of FIG. 1A has various louvers (105). A louver is a baffle used to direct or control the flow of air through an air vent. A louver may extend beyond the face of the air vent grill, as in the example of FIG. 1A, or may be inset into the face of the air vent grill. Still further, some louvers may be placed inside an air vent grill. A louver may be fixed in place or allowed to move through a range of positions. In fact, many air vents are designed with both fixed and moveable louvers. Whether fixed or moveable, a louver may be configured at various angles relative the face of the air vent grill including, for example, slanted or perpendicular to the face of the air vent grill. In the example of FIG. 1A, the louvers (105) are fixed in place at slanted angles and are formed as integral components with the air vent grill (106).

In the example of FIG. 1A, the removable air duct sealing system (100) includes a support plate (110). The support plate (110) of FIG. 1A provides a surface to which the other components of the air duct sealing system (100) may be connected. The support plate (110) of FIG. 1A has a first side (112), which faces the room when installed, and a second side (114), which faces the wall or ceiling when installed.

In the example of FIG. 1A, the second side (114) is the side of the support plate (110) that faces toward the air vent grill (106) when installed, and the first side (112) of the support plate (110) that faces away from the air vent grill (106) when installed. The support plate (110) of FIG. 1A may be formed out of a variety of materials, including but not limited to, metal, carbon-composite, polycarbonate, polyurethane, plastic, harden rubber, or any other material as will occur to those of skill in the art.

The support plate (110) of FIG. 1A has opening (116) extending through the support plate (110) from the first side (112) to the second side (114). This opening permits the passage of air between a duct pressurization or depressurization system and the air duct system (102).

The support plate (110) of FIG. 1A includes a flange (120) along the perimeter of the opening (116). The flange of FIG. 1A extends away from the first side (112) toward the interior of the room and serves as an interface for connecting an air duct to the removable air duct sealing system (100) of FIG. 1A that would carry airflow to or from a pressurization or depressurization system.

In FIG. 1A, the exemplary removable air duct sealing system (100) includes a gasket (160) configured on the second side (114) of the support plate (110). The gasket (160) of FIG. 1A is capable of blocking airflow through a portion of the air duct sealing system (100) when the gasket (160) is pressed toward the air vent grill (106). The gasket (160) of FIG. 1A is configured along the perimeter of the support plate (110), but those of skill in the art will recognized that other configurations may exist. For example, a gasket useful to embodiments of the present invention may be substantially planar in shape and configured along substantially all of the second side (114) of the support plate (110), except across the opening (116). Of course, still further configurations could be utilized.

The gasket (160) of FIG. 1A helps create a seal between the air duct sealing system (100) and a region around the air vent that is being sealed with the air duct sealing system (100) as the sealing system (100) presses toward the air vent. A gasket is a mechanical seal that fills the space between two mating surfaces. Gaskets allow "less-than-perfect" mating surfaces to seal by filling in irregularities of the mating surfaces. For example, the gasket of may help the air duct sealing system seal against rough surface such as an interior ceiling or wall with a popcorn texture or other rough texture. The gasket may be formed from a variety of materials as will occur to those of skill in the art, including, for example, foam, rubber, nylon, or plastic. When formed from material such as foam, readers will note that there are two types of foam that could be used to create a gasket according to embodiments of the present invention—open-cell foam and closed-cell foam.

In open-cell foam, the cell walls, or surfaces of the bubbles, are broken and air fills all of the spaces in the material. In this manner, open-cell foam creates a permeable barrier that may allow air to flow through it when uncompressed. When compressed, however, the open-cell foam may provide enough of a barrier to serve as a seal. The open-cell nature makes the foam soft or weak, as if it were made of broken balloons or soft toy rubber balls. The insulation value of this foam is related to the insulation value of the calm air inside the matrix of broken cells.

In closed-cell foam, most of the cells or bubbles in the foam are not broken; they resemble inflated balloons or soccer balls, piled together in a compact configuration. This makes the closed-cell foam strong or rigid because the bubbles are strong enough to withstand high-pressure. Although closed-cell foam is rigid, it has varying degrees of hardness, depending on its density. Because the cell walls of closed-cell foam are not generally broken, closed-cell foam provides greater resistance to air leakage than that of open-celled foam.

In FIG. 1A, the exemplary removable air duct sealing system (100) includes a sawtooth connector (130) connected to the interior surface (122) of the flange (120). The term sawtooth refers to the overall configuration of the connector (130) resembling the cutting teeth of a saw. The connector (130) of FIG. 1A, however, does not actually cut anything but those 'teeth' serve the purposes of holding the air duct sealing system (100) in place adjacent to the grill (106) in the example of FIG. 1A. In this way, the sawtooth connector (130) of FIG. 1A serves as the interface between the air duct sealing system (100) and the air vent grill (106). Much like the support plate (110), the sawtooth connector (130) of FIG. 1A may be formed out of a variety of materials, including but not limited to, metal, carbon-composite, polycarbonate, polyurethane, plastic, harden rubber, or any other material as will occur to those of skill in the art.

In FIG. 1A, there are two sawtooth connectors (130). Turning to FIG. 1B, FIG. 1B sets forth a line drawing illustrating a perspective view of the exemplary sawtooth connector of FIG. 1A that is useful in an exemplary removable air duct sealing system for obstructing or directing airflow through portions of an air duct system according to embodiments of the present invention. The sawtooth connector (130) of FIGS. 1A and 1B has five detents (132) slanted back toward one end of the sawtooth connector (130) and being shaped substantially similar to a parallelogram. Shape and number of the detents (132) in the example of FIGS. 1A and 1B are for example only. One of ordinary skill in the art will recognize the number of and shape of the detents of an exemplary sawtooth connector useful in embodiments of the present invention may vary depending on the shape, size, configuration, and other aspects of the louvers into which an exemplary sawtooth connector may be inserted.

The detents (132) shown FIG. 1B are configured to catch a backside (134) of a louver (105) of the air vent grill (106) in FIG. 1A to hold the removable air duct sealing system (100) in place covering the air vent grill (106). In some embodiments, the detents serve to create a threshold force needed to insert or remove an exemplary sawtooth connector through the louvers of an air vent grill. The detents can be sized and designed so that the threshold force is not reached merely by the weight of the air vent seal system (100) but rather requires the extra force provided by an operator inserting or remove the sawtooth connectors from the louvers. Alternatively, rather than use the design of the detents to create a threshold force needed to insert or remove a sawtooth connector, the detents could merely grip the backside of the louvers until the detents are repositioned to allow the detents to slide out from between the louvers. Either design configuration, as well as other configurations as will occur to those of skill in the art, will serve to hold exemplary air duct sealing systems against an air vent grill, and depending on the particular design the detents could be formed to be flexible or rigid.

While in the example of FIG. 1A, the detents (132) shown FIG. 1B are configured to catch a backside (134) of a louver (105) of the air vent grill (106) to hold the removable air duct sealing system (100) in place, one of ordinary skill in the art will recognize that this is for example only and for limitation. In other embodiments, the exemplary detents useful in embodiments of the present invention may connect to a crossbar behind the air vent grill inside the air duct system.

Turning back toward FIG. 1A, the removable air duct sealing system (100) includes a pin (140) mounted to the interior surface (122) of the flange (120). The pin (140) of FIG. 1A allows the sawtooth connector (130) to be hingably coupled to the pin (140) via a hole (129) formed in the sawtooth connector (130). The freedom of movement that the hinge between the sawtooth connector (130) and the air vent sealing system (100) provides assists an operator when inserting the connector (130) into or removing the connector (130) from the louvers (105). Those of skill in the art will recognize that the use of a hinge is but one way of forming a moveable connection. Another example of a moveable connection might include the use of a rod or rail that connects to another component by passing through a guide attached to the other component. The rod or rail passes through the guide and is held in place by a fastener, which in turn could be a screw that provides force to the rod or rail to hold it in place. Still further, a connector could be coupled to the interior of the flange in a way that allow the sawtooth connector to assume one origination when inserted into the louvers and then flipped up and held by a latch into a different orientation, which may for example be approximately ninety degrees' difference, placing a louver between the detents and preventing the sawtooth connector from being removed until the connector is again rotated back into the original position. Of course, these examples described are for explanation only and not for limitation. Still other moveable connections may be utilized in embodiments of the present invention as will occur to those of skill in the art.

Figure 2A:
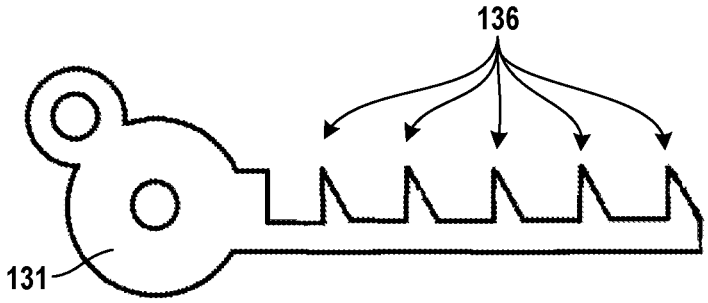
FIG. 2A sets forth a line drawing illustrating a perspective view of an exemplary sawtooth connector that is useful in an exemplary removable air duct sealing system for obstructing or directing airflow through portions of an air duct system according to embodiments of the present invention.

The detents of an exemplary sawtooth connector useful in embodiments of the present invention may be configured in a variety of ways. FIG. 2A sets forth a line drawing illustrating a perspective view of an exemplary sawtooth connector (131) that is useful in an exemplary removable air duct sealing system for obstructing or directing airflow through portions of an air duct system according to embodiments of the present invention. The exemplary sawtooth connector (131) of FIG. 2A includes five detents (136) configured in a triangular manner and slanted back toward one end of the connector (131). In other embodiments, however, triangular detents may be configured straight out from the body of the connector without slanting backward.

Figure 2B:
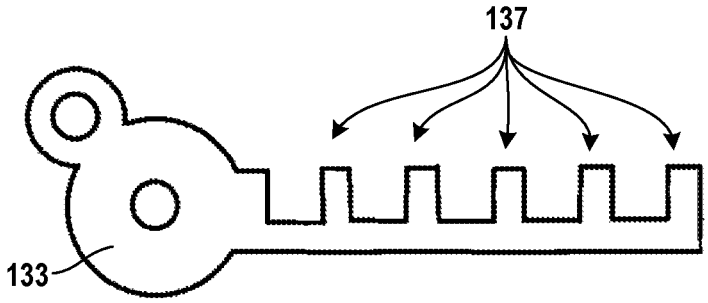
FIG. 2B sets forth a line drawing illustrating a perspective view of an exemplary sawtooth connector that is useful in an exemplary removable air duct sealing system for obstructing or directing airflow through portions of an air duct system according to embodiments of the present invention.

FIG. 2B sets forth a line drawing illustrating a perspective view of another exemplary sawtooth connector (131) that is useful in an exemplary removable air duct sealing system for obstructing or directing airflow through portions of an air duct system according to embodiments of the present invention. The exemplary sawtooth connector (133) of FIG. 2B includes five detents (137) configured as rectangles.

Figure 2C:
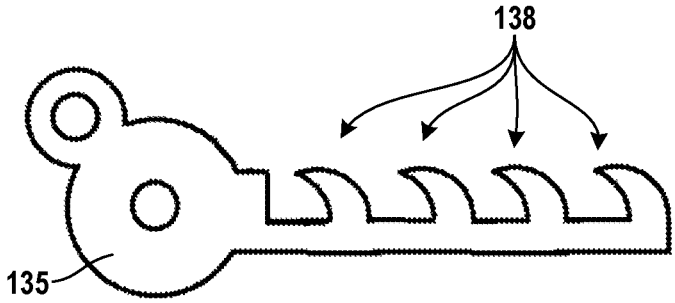
FIG. 2C sets forth a line drawing illustrating a perspective view of an exemplary sawtooth connector that is useful in an exemplary removable air duct sealing system for obstructing or directing airflow through portions of an air duct system according to embodiments of the present invention.

FIG. 2C sets forth a line drawing illustrating a perspective view of another exemplary sawtooth connector (131) that is useful in an exemplary removable air duct sealing system for obstructing or directing airflow through portions of an air duct system according to embodiments of the present invention. The exemplary sawtooth connector (135) of FIG. 2C includes four detents (138) configured as waves.

Figure 3:
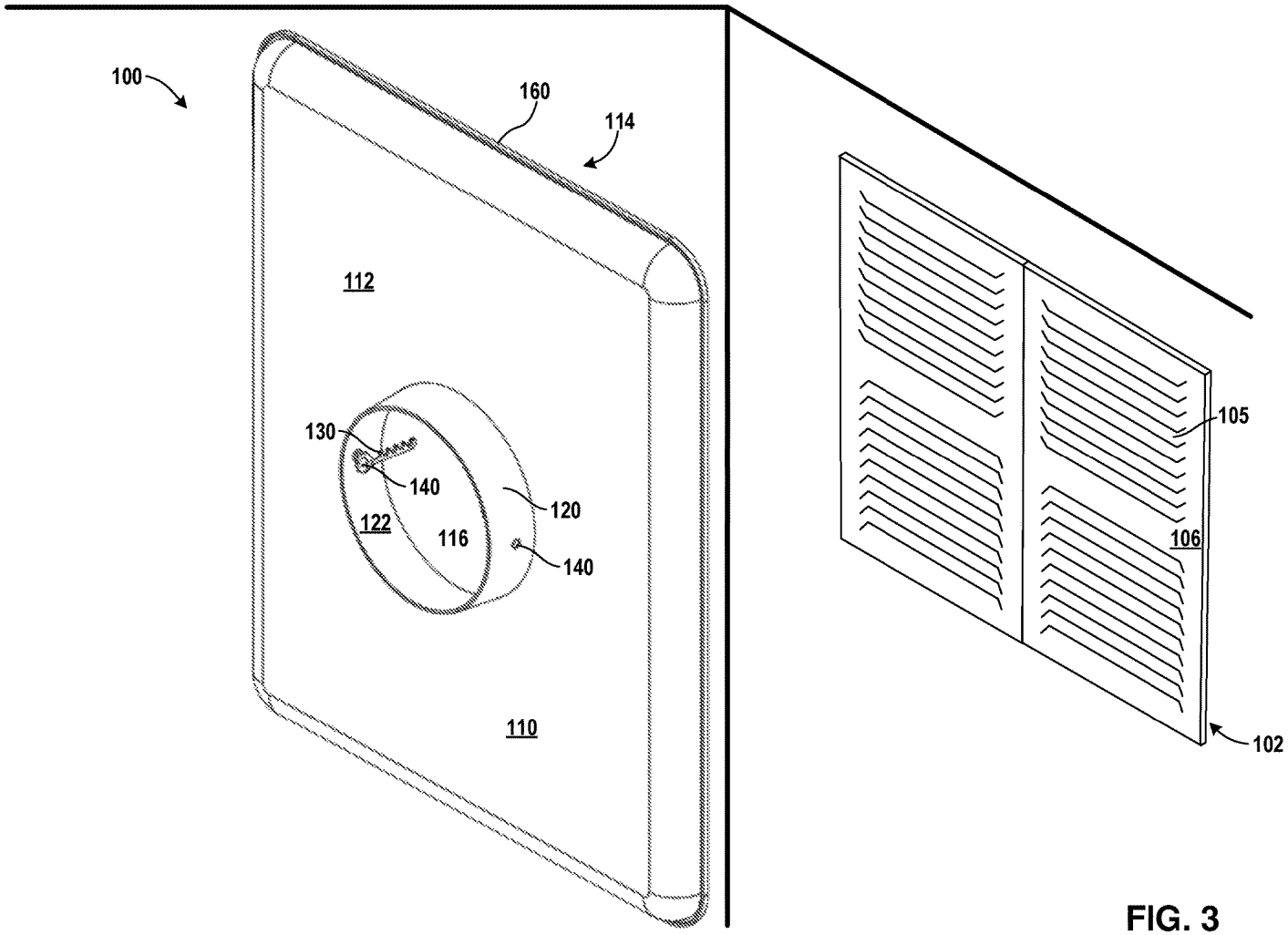
FIG. 3 sets forth a drawing illustrating another perspective view of the exemplary removable air duct sealing system of FIG. 1A for obstructing or directing airflow through portions of an air duct system according to embodiments of the present invention.

To provide a different perspective view of the exemplary air duct sealing system of FIG. 1A, FIG. 3 sets forth a drawing illustrating another perspective view of the exemplary removable air duct sealing system of FIG. 1A for obstructing or directing airflow through portions of an air duct system according to embodiments of the present invention. The exemplary components are the same as that described with reference to FIGS. 1A and 1B.

Figure 4B:
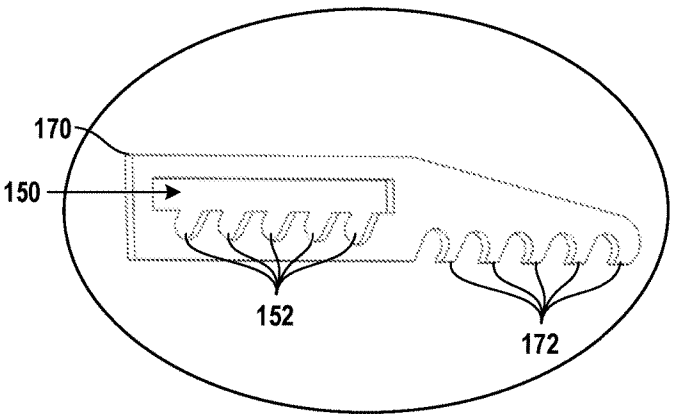
FIG. 4B sets forth a line drawing illustrating a perspective view of the exemplary sawtooth connector of FIG. 4A that is useful in an exemplary removable air duct sealing system for obstructing or directing airflow through portions of an air duct system according to embodiments of the present invention.
Figure 4A:
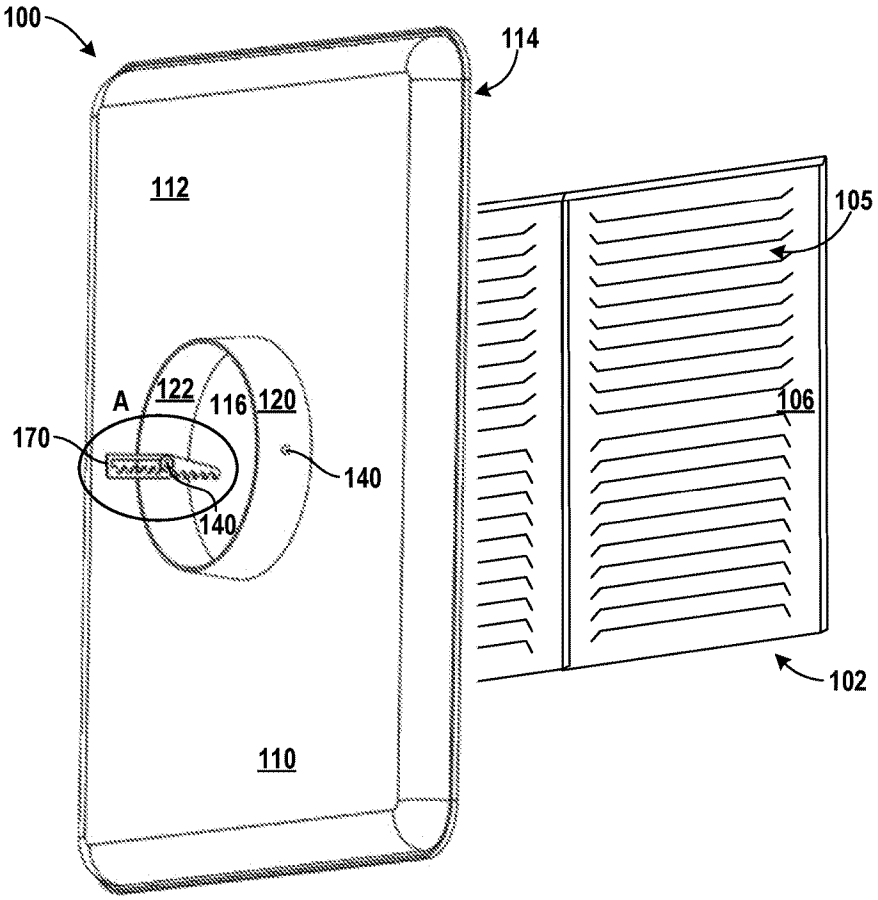
FIG. 4A sets forth a drawing illustrating a perspective view of the exemplary removable air duct sealing system of FIG. 1A for obstructing or directing airflow through portions of an air duct system according to embodiments of the present invention utilizing another exemplary sawtooth connector according to embodiments of the present invention.

Turning to FIG. 4A, FIG. 4A sets forth a drawing illustrating a perspective view of the exemplary removable air duct sealing system (100) of FIG. 1A for obstructing or directing airflow through portions of an air duct system (102) according to embodiments of the present invention utilizing another exemplary sawtooth connector according to embodiments of the present invention. The exemplary removable air duct sealing system (100) of FIG. 4A is the same as that system (100) described with reference to FIG. 1A, except that the sawtooth connector (130) in FIG. 1A has been replace with the exemplary sawtooth connector (170) shown in FIG. 4A. The exemplary components are the same as that described with reference to FIG. 1A.

FIG. 4B sets forth a line drawing illustrating a perspective view of the exemplary sawtooth connector (170) of FIG. 4A that is useful in an exemplary removable air duct sealing system (100) for obstructing or directing airflow through portions of an air duct system according to embodiments of the present invention. The sawtooth connector (170) of FIG. 4B includes an interior track (150) and a various interior slots (152) adjacent to and connected to the interior track (150). The slots (152) in FIG. 4B are slanted toward one end of the connector (170). The track (150) and the slots (152) in the example of FIG. 4B allow the sawtooth connector (130) to slide along the pin (140) shown in FIG. 4A within the interior track (150). When the pin (140) is placed into one of the slots (152), the sawtooth connector (130) no longer slides along the interior track (150). Rather, the sawtooth connector (130) of FIGS. 4A and 4B is secured relative to the removable air duct sealing system (100) when one of the plurality of detents (172) of the sawtooth connector (170) catches the backside of the louver (105) of the air vent grill (106).

The tract (150) and various notches (152) of FIG. 4B allow an operator utilizing the exemplary air duct sealing system (100) of FIG. 4A to have a range of motion in maneuvering the sawtooth connector (170) to effectively insert the connector (170) into and remove the connector (170) from the air vent grill (106) while attached to the remainder of the sealing system (100). To hold the sawtooth connector (170) on the pin (140), the head of the pin (140) may be formed to protrude out from the connector (170) and configured wider than the track (150). Alternatively, a fastener could be configured to screw into the pin (140) and have a body that would hold the connector against the interior surface (122) of the flange (120) using friction. Of course, these are exemplary methods meant for explanation only and not for limitation. Other configurations for holding the exemplary sawtooth connector (170) of FIGS. 4A and 4B on the pin (140) as would occur to those of skill of the art would also be useful in embodiments of the present invention.

In the example of FIG. 4B, the sawtooth connector (170) has an angular configuration at the area of the connector (170) with the detents (172). The angular configuration shown in FIG. 4B facilitates insertion of the sawtooth connector (170) between louvers (105) of the air vent grill (106) shown in FIG. 4A.

Figure 5:
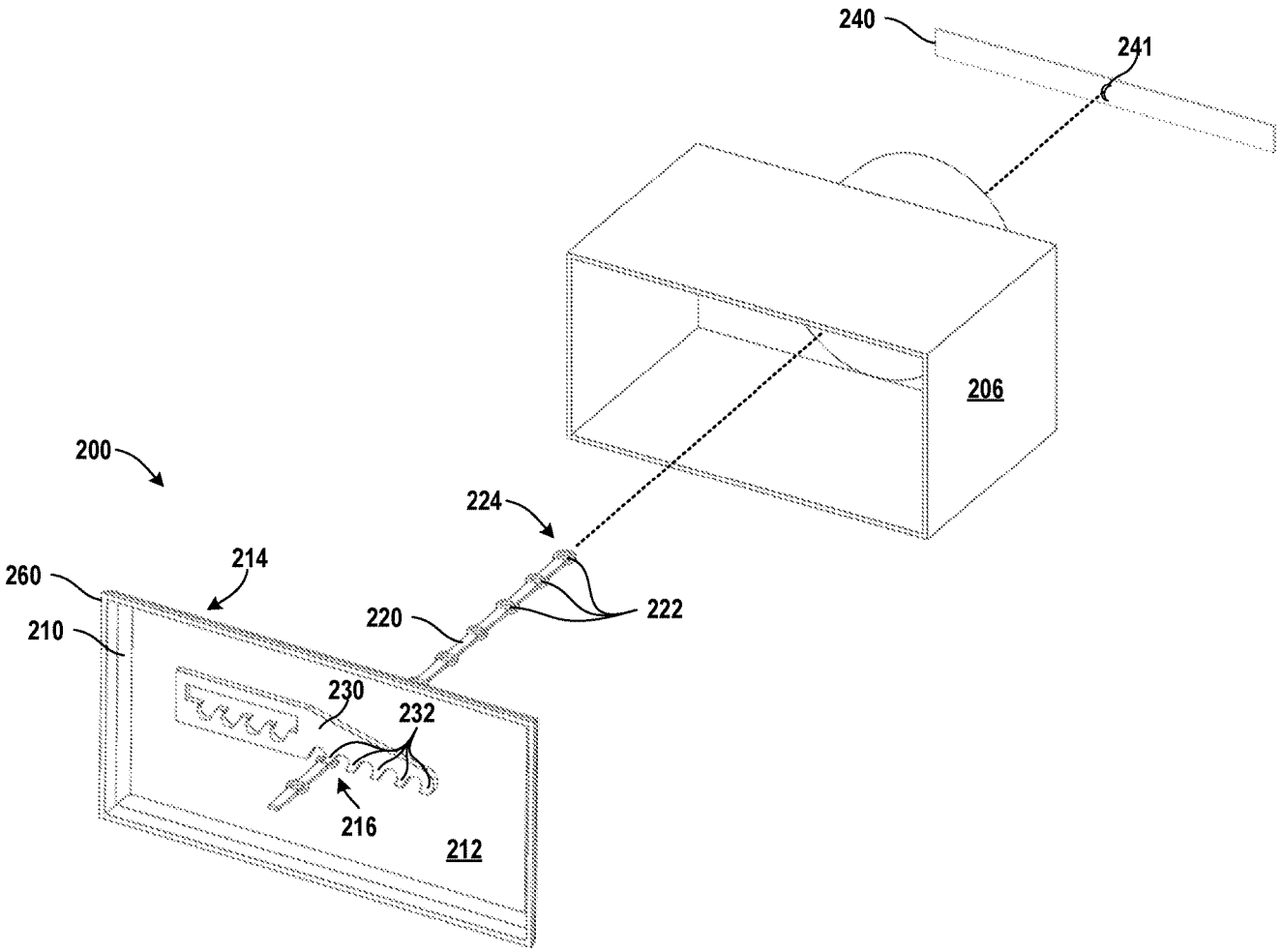
FIG. 5 sets forth a drawing illustrating a perspective view of another exemplary removable air duct sealing system for obstructing or directing airflow through portions of an air duct system according to embodiments of the present invention.

While some embodiments of the present invention may be used to block or direct air flow through an air duct terminated with an air vent grill, other embodiments of the present invention may merely be used to block airflow in an air duct that does not have an air vent grill. For example, during construction of a building, it would be useful to be able to plug the HVAC system so that dirt and dust during construction does not get into the HVAC system. During the construction stage, the HVAC system does not typically have a grill installed, but rather the only the register boot is installed. Turning to FIG. 5, FIG. 5 sets forth a drawing illustrating a perspective view of another exemplary removable air duct sealing system (200) for obstructing or directing airflow through portions of an air duct system according to embodiments of the present invention. In the example of FIG. 5, the air duct system has an air duct terminated at register boot (206).

The removable air duct sealing system (200) of FIG. 5 includes a support plate (210). The support plate (210) of FIG. 5 has a first side (212) and a second side (214). The support plate (210) of FIG. 5 has a small opening (216) extending through the support plate (210) from the first side (212) to the second side (214). The support plate (210) of FIG. 5 also has a gasket (260).

In the example of FIG. 5, the removable air duct sealing system (200) includes a flexible tie (220). The flexible tie (220) of FIG. 5 has a plurality of loops (222) built into the flexible tie (220). The flexible tie (220) of FIG. 5 is configured to pass through the opening (216) of the support plate (210).

The removable air duct sealing system (200) in the example of FIG. 5 includes a crossbar (240) connected at the distal end (224) of the flexible tie (220). The crossbar (240) and flexible tie (220) of FIG. 5 connect using a hook (241). This exemplary connection is for illustration only and not for limitation because there are many other ways to connect to the flexible tie (220) to the cross bar (240) according to embodiments of the present invention. For example, the flexible tie (220) might pass through a slot formed into the cross bar and held with a pin, the flexible tie (220) might be molded around the crossbar (240), the flexible tie (220) might be fastened to the crossbar (240) with a rivet fastener, or any other connection mechanism as would occur to those of skill in the art.

In the example of FIG. 5, the crossbar (240) and flexible tie (220) are configured to permit the crossbar (240) and flexible tie (22) to pass through the register boot (206) when positioned in a first orientation and resist removal of the flexible tie (220) from the register boot (206) when positioned in a second orientation. FIG. 5 illustrates the second orientation that would be prevent removal of the crossbar (240) and flexible tie (220) from the register boot (206).

Although in the example of FIG. 5, the crossbar (240) is shown as a solid rectangular, fixed component, other embodiments of a crossbar are within the scope of the present invention. For example, the crossbar may be formed to resemble a cylinder that is spring loaded. The outer surface may be composed of two or more such cylinders that fit together in a telescoping manner such that a spring keeps the outer cylindrical shell expanded to a maximum size. An operator may then squeeze such an exemplary cylindrical crossbar to shorten the length of the crossbar as it is inserted through the collar of a register boot. After reaching the other side of the boot, the operator could release the ends of the cylindrical crossbar and the spring loaded action would allow the exemplary crossbar to resume is longer shape that would prevent the crossbar from being pulled by through the register boot until the operator reoriented the crossbar by squeezing the outer shell smaller again or repositioning the crossbar in some manner to allow it to pass through the collar of a register boot.

The removable air duct sealing system (200) in the example of FIG. 5 includes a sawtooth connector (230). The sawtooth connector (230) includes various detents (232) configured to catch one of the loops (222) of the flexible tie (220) on the first side (212) of the support plate (210). When an operator pulls on the flexible tie (220) and reveals the closest loop (222) to the distal end (224) that is able to pass through the opening (216) of the support plate (210) and puts one of the detents (232) of the sawtooth connector (230) through that loop, the air duct sealing system (200), including the support plate (210), will be secured in a fixed position relative to the register boot (206) when the crossbar (240) is positioned in a second orientation.

Figure 6B:
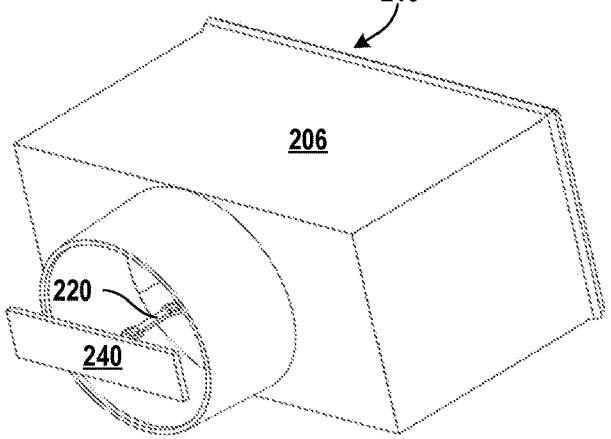
FIG. 6B sets forth a drawing illustrating still another perspective view of the exemplary removable air duct sealing system of FIG. 5 for obstructing or directing airflow through portions of an air duct system according to embodiments of the present invention.
Figure 6A:
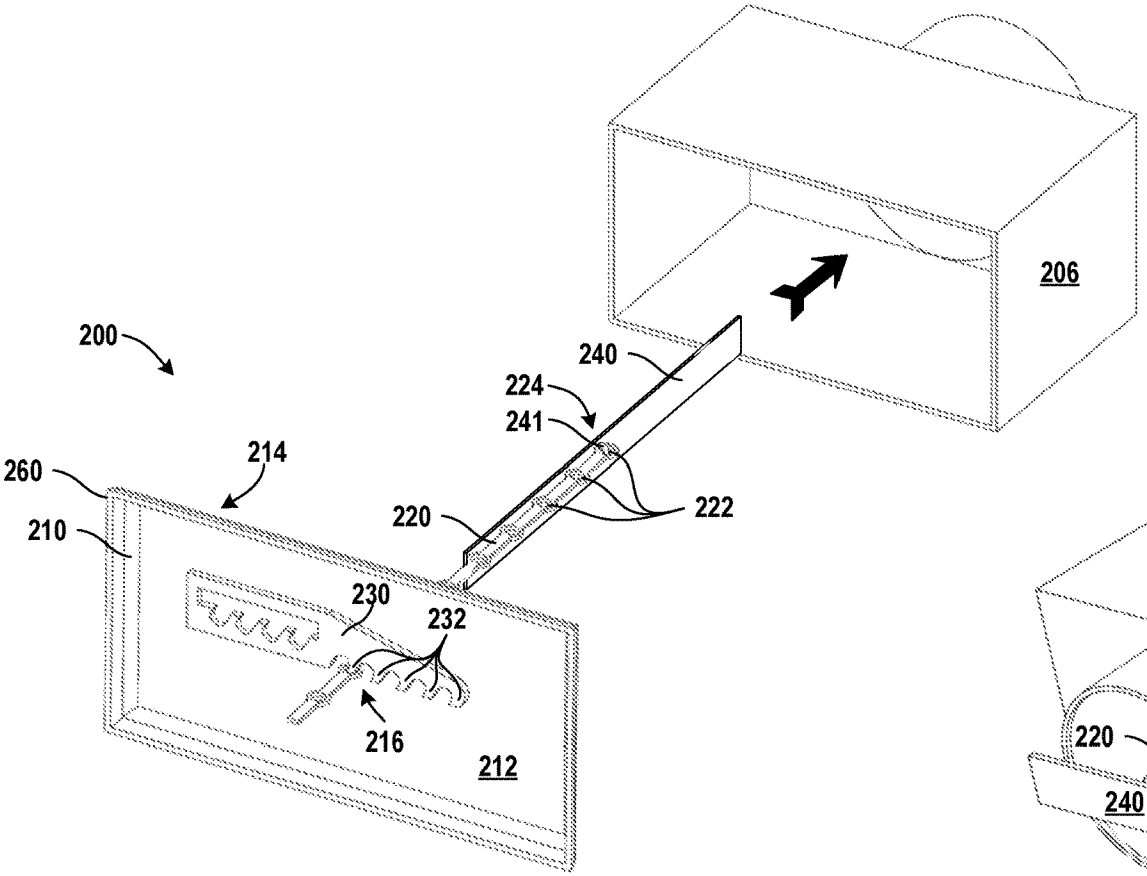
FIG. 6A sets forth a drawing illustrating another perspective view of the exemplary removable air duct sealing system of FIG. 5 for obstructing or directing airflow through portions of an air duct system according to embodiments of the present invention.

FIG. 6A sets forth a drawing illustrating another perspective view of the exemplary removable air duct sealing system (200) of FIG. 5 for obstructing or directing airflow through portions of an air duct system according to embodiments of the present invention. The removable air duct sealing system (200) of FIG. 6A is the same system (200) illustrated in FIG. 5, except that the crossbar (240) and flexible connector (240) are configured in the first orientation that allows the crossbar (240) and flexible connector (240) to pass through the register boot (206).

FIG. 6B sets forth a drawing illustrating still another perspective view of the exemplary removable air duct sealing system (200) of FIG. 5 for obstructing or directing airflow through portions of an air duct system according to embodiments of the present invention. The removable air duct sealing system (200) of FIG. 6B is the same system (200) illustrated in FIG. 6A, except that the crossbar (240) and flexible connector (240) are configured in the second orientation that prevents the crossbar (240) and flexible connector (240) from being removed from the register boot (206).

Figure 7:
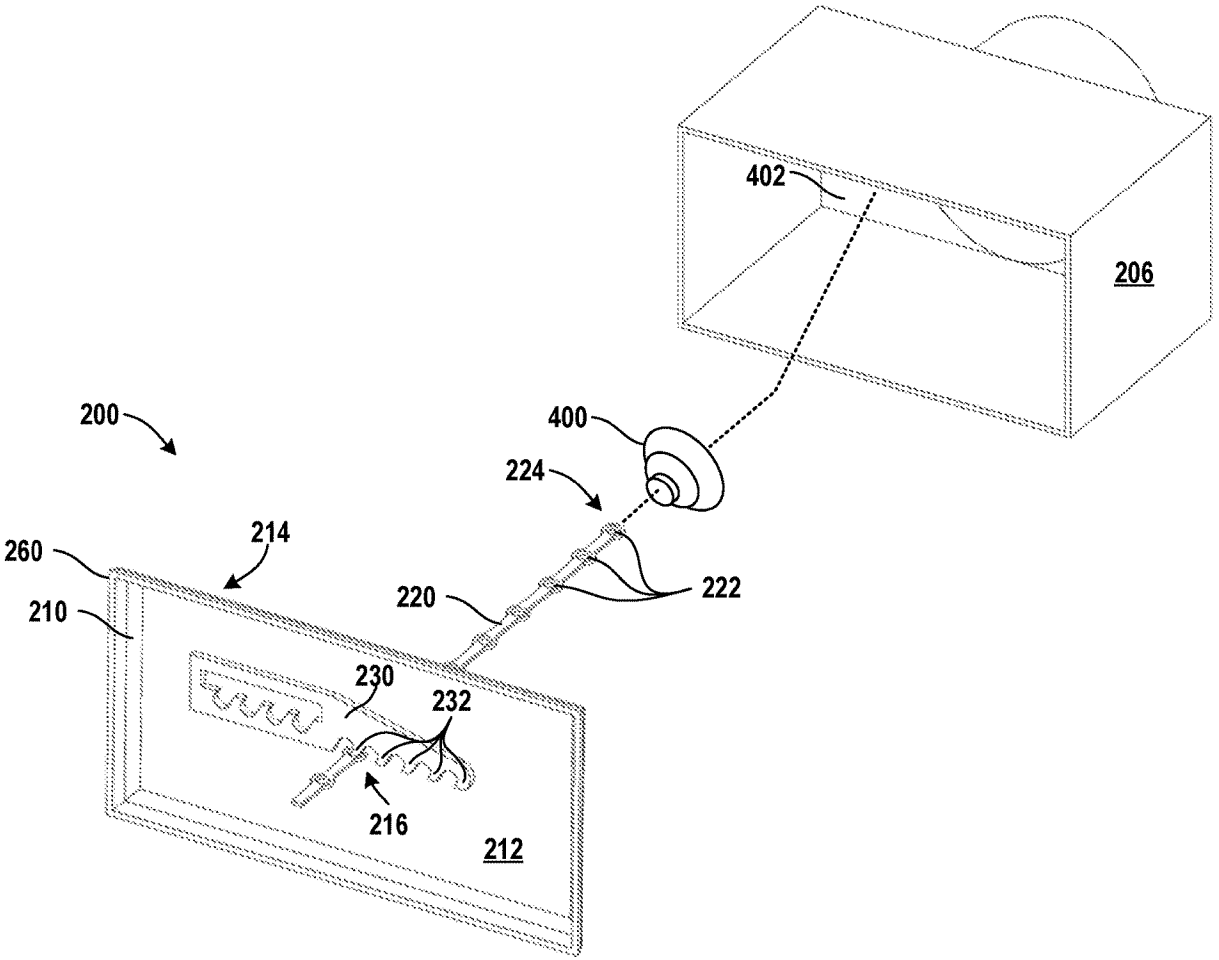
FIG. 7 sets forth a drawing illustrating a perspective view of another exemplary removable air duct sealing system for obstructing or directing airflow through portions of an air duct system according to embodiments of the present invention.

While the exemplary air duct sealing system of FIGS. 5, 6A, and 6B utilize a crossbar to prevent the flexible tie from being removed from the register boot, other mechanisms of securing the flexible tie to plug the opening of the register boot as will occur to those of skill in the art may also be used. FIG. 7 sets forth a line drawing illustrating a perspective view of the exemplary removable air duct sealing system (200) for obstructing or directing airflow through portions of an air duct system according to embodiments of the present invention that utilizes a suction cup. The exemplary removable air duct sealing system (200) of FIG. 7 is the same system (200) of FIG. 5, except that the crossbar (240) of FIG. 5 has been replaced with a suction cup (400).

The suction cup (400) of FIG. 7 is operatively coupled to the distal end (224) of the flexible tie (220) and configured to resist removal of the flexible tie (220) from the register boot (206) when positioned in the register boot (206). In the example of FIG. 7, the suction cup (400) is installed inside the register boot (206) when an operator affixes the suction cup (400) to the back wall (402) of the register boot). Because the flexible tie (220) is flexible in nature, the suction cup (400) need not be attached at the center of the register boot (206) as is often the case when a crossbar is utilized. The suction cup (400) of FIG. 7 may attach to the distal end (224) of the flexible tie (220) in a variety of ways as will occur to those of skill in the art in a manner similar to the manner in which a flexible tie may attach to a crossbar useful in embodiments of the present invention. The sawtooth connector (230) of FIG. 7 includes various detents (232) configured to catch one of the loops (222) of the flexible tie (220) passing through the support plate (210) and to secure the support plate (210) in a fixed position relative to the register boot (206) when the suction cup (400) is positioned in the register boot (206).

While certain exemplary embodiments have been described in details and shown in the accompanying drawings, it is to be understood that such embodiments are merely illustrative of and not devised without departing from the basic scope thereof, which is determined by the claims that follow.

What I claim is:

1. A removable air duct sealing system for obstructing and directing airflow through portions of an air duct system, the air duct system having at least one air duct terminated at an air vent grill, the removable air duct sealing system comprising:

a support plate having a first side and a second side, the support plate having opening extending through the support plate from the first side to the second side;

a flange along the opening extending away from the first side, the flange having an interior surface;

a sawtooth connector operatively coupled to the interior surface of the flange, the sawtooth connector comprising a plurality of detents, the plurality of detents configured to catch the air vent grill to hold the removable air duct sealing system in place covering the air vent grill; and a pin mounted to the interior surface of the flange, wherein the sawtooth connector is hingably coupled to the pin.

2. The removable air duct sealing system of claim 1 wherein the plurality of detents are slanted.

3. The removable air duct sealing system of claim 1 wherein the plurality of detents are each shaped as a parallelogram.

4. The removable air duct sealing system of claim 1 wherein the plurality of detents are each shaped as a triangle.

5. The removable air duct sealing system of claim 1 wherein the plurality of detents are each shaped as a wave.

6. The removable air duct sealing system of claim 1 wherein the sawtooth connector is flexible.

7. The removable air duct sealing system of claim 1 wherein the sawtooth connector is rigid.

8. The removable air duct sealing system of claim 1 wherein the sawtooth connector has an angular configuration at the plurality of detents to facilitate insertion of the sawtooth connector between louvers of the air vent grill.

9. The removable air duct sealing system of claim 1 further comprising a gasket configured on the second side of the support plate, the gasket capable of blocking airflow through a portion of the air duct sealing system when the gasket is pressed toward the air vent grill.

10. The removable air duct sealing system of claim 9 wherein the gasket is configured along the perimeter of the support plate.

11. The removable air duct sealing system of claim 9 wherein the gasket is substantially planar in shape and configured along substantially all of the second side of the support plate.

12. A removable air duct sealing system for obstructing and directing airflow through portions of an air duct system, the air duct system having at least one air duct terminated at an air vent grill, the removable air duct sealing system comprising:

a support plate having a first side and a second side, the support plate having opening extending through the support plate from the first side to the second side;

a flange along the opening extending away from the first side, the flange having an interior surface;

a sawtooth connector operatively coupled to the interior surface of the flange, the sawtooth connector comprising a plurality of detents, the plurality of detents configured to catch the air vent grill to hold the removable air duct sealing system in place covering the air vent grill;

a pin mounted to the interior surface of the flange; and wherein the sawtooth connector further comprises an interior track and a plurality of interior slots adjacent to the interior track configured to allow the sawtooth connector to slide along the pin within the interior track and allow the pin to secure the sawtooth connector relative to the removable air duct sealing system when the pin is positioned in one of the plurality of interior slots and one of the plurality of detents of the sawtooth connector catches the air vent grill.

13. The removable air duct sealing system of claim 12 wherein the plurality of interior slots are slanted.

14. The removable air duct sealing system of claim 12 wherein the sawtooth connector has an angular configuration at the plurality of detents to facilitate insertion of the sawtooth connector between louvers of the air vent grill.

15. The removable air duct sealing system of claim 12 further comprising a gasket configured on the second side of the support plate, the gasket capable of blocking airflow through a portion of the air duct sealing system when the gasket is pressed toward the air vent grill.

16. The removable air duct sealing system of claim 15 wherein the gasket is configured along the perimeter of the support plate.

17. The removable air duct sealing system of claim 15 wherein the gasket is substantially planar in shape and configured along substantially all of the second side of the support plate.

18. The removable air duct sealing system of claim 12 wherein the plurality of detents are each shaped as a parallelogram.

19. The removable air duct sealing system of claim 12 wherein the sawtooth connector is flexible.

20. The removable air duct sealing system of claim 12 wherein the sawtooth connector is rigid.

* * * * *